US006672741B1

(12) United States Patent
Young

(10) Patent No.: US 6,672,741 B1
(45) Date of Patent: Jan. 6, 2004

(54) LIGHT EMITTING DIODE REFLECTOR

(76) Inventor: Tony Chunlung Young, Block C, 1/F., 3-5 Pat Tat Street, On Tat Factory Building, San Po Kong, Hong Kong (CN)

( * ) Notice: Subject to any disclaimer, the term of this patent is extended or adjusted under 35 U.S.C. 154(b) by 0 days.

(21) Appl. No.: 10/246,899

(22) Filed: Sep. 16, 2002

(51) Int. Cl.[7] ..... F21V 3/00

(52) U.S. Cl. ..... 362/311; 362/347; 362/519; 362/307; 362/310; 362/350; 362/800

(58) Field of Search ..... 362/311, 347, 362/519, 307, 310, 350, 800

(56) References Cited

U.S. PATENT DOCUMENTS 4,463,410 A * 7/1984 Mori ..... 362/20

6,149,283 A * 11/2000 Conway et al. ..... 362/236

* cited by examiner

*Primary Examiner*—Sandra O'Shea
*Assistant Examiner*—Mark Tsidulko

(57) ABSTRACT

The present invention relates to a light emitting diode reflector which is installed in portable lighting equipment such as electric torches. The light emitting diode reflector comprises a reflector which is a one piece parabolic mirror, a front cover which is placed upon the open end of the reflector and a light emitting diode which is mounted at the center of the front cover facing the reflector. The light emitting diode reflector increases the light intensity significantly to meet the user's requirement and maintains the advantage of energy saving of using a light emitting diode as the light source.

1 Claim, 2 Drawing Sheets

LIGHT EMITTING DIODE REFLECTOR

TITLE OF THE INVENTION

A light emitting diode reflector

BACKGROUND OF THE INVENTION

The present invention relates to portable lighting equipment powered by dry cells and more particularly pertains to a reflector for such lighting equipment.

Common portable lighting equipment powered by dry cells such as an electric torch generally comprises a reflector assembly to which the body is screwed with batteries and a switching device installed inside the body. The front end of the body is connected to a light source. A reflector for the light source is installed to form part of the reflector assembly. As illustrated in FIG. 1, there is a hole in the center of the reflector 21. The light source 22, which is connected to the front end of the body 23, passes through the hole to form part of the reflector assembly. The light source 22 emits light. After reflection caused by the reflector 21, a large portion of the light emitted directly forward is not collimated. The conventional mounting of the light source 22 at the center of the reflector 21 blocks a large part of the reflector 21 rendering that part useless. When a light emitting diode is used as the light source, it saves energy but as it emits weaker light, the light intensity cannot meet the user's requirement even after the increase by the reflector. When an incandescent light bulb is adopted as the light source, the light intensity is higher and is sufficient to meet the user's requirement but it consumes more energy and it is troublesome and not economical to change batteries frequently.

BRIEF SUMMARY OF THE INVENTION

In view of the aforesaid disadvantages now present in the prior art, the present invention provides a light emitting diode reflector of a totally different design concept for portable lighting equipment powered by dry cells. It can increase the light intensity significantly to meet the user's requirement and maintain the advantage of energy saving of using a light emitting diode as the light source.

To attain this, the present invention generally comprises a reflector, a front cover and a light emitting diode. The reflector is a one-piece parabolic mirror having no holes. The front cover having no holes is placed upon the open end of the reflector. The light emitting diode is mounted at the center of the front cover facing the converging point of the reflector's arc.

The two wires of the light emitting diode are led from the center of the front cover to its edge and then to the back of the reflector and finally to the body of the lighting equipment where the batteries and the switching device are installed, thus completing the circuit between the batteries and the light emitting diode.

The parabola formulae of the reflector's arc is $y^2=4Ax$, in which A is the distance between the maximum light emitting center of the light emitting diode and the converging point of the reflector's arc.

The open end of the reflector forms a plane.

The front cover is made up of a transparent material.

A casing is designed to encompass the reflector and to connect to the body of the portable lighting equipment.

It is an object of the present invention to provide a new light emitting diode reflector for use in portable lighting equipment powered by dry cells which, in contrary to the traditional construction method of opening a hole in the center of the reflector for the light emitting diode to pass through, forms one piece without opening a hole in the center and the light emitting diode is mounted at the center of the front cover having no holes and facing the converging point of the reflector, thus causing light emitting from the light emitting diode reflected parallel and the light intensity increased significantly.

It is another object of the present invention to provide a new light emitting diode reflector which is of simple and reliable construction.

It is a further object of the present invention to provide a light emitting diode reflector which is susceptible of a low cost of manufacture with regard to both materials and labor, thereby making the portable lighting equipment powered by dry cells containing the light emitting diode reflector susceptible of low prices of sale and thus economically available to the buying public.

An even further object of the present invention is to provide a new light emitting diode reflector for use in portable lighting equipment powered by dry cells which increases the light intensity significantly to meet the user's requirement and maintains the advantage of energy saving of using a light emitting diode as the light source, thus overcoming the disadvantages of the prior art.

DETAILED DESCRIPTION OF THE INVENTION

Figure 1:
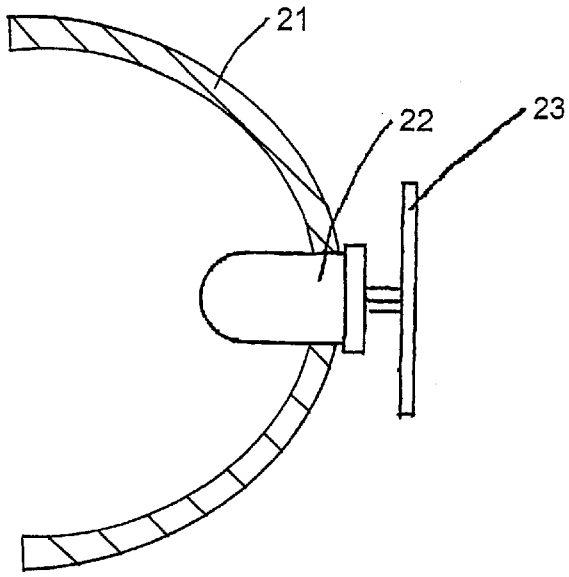
FIG.1 Prior Art
FIG. 1 shows the relationship between the reflector and the light source of a traditional electric torch.
Figure 2:
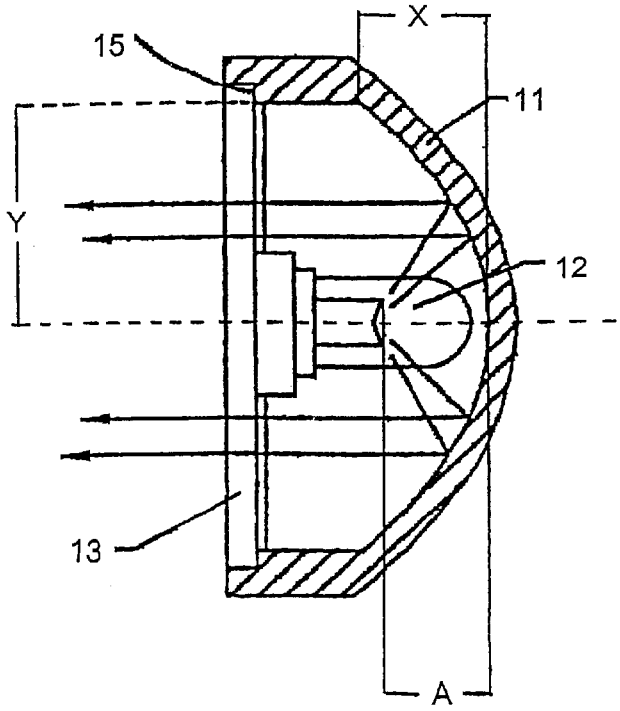
FIG. 2 shows the relationship between the reflector and the light emitting diode of the present invention.

As illustrated in FIG. 2, the light emitting diode reflector generally comprises a reflector 11, a front cover 13 and a light emitting diode 12.

The reflector 11 is a one-piece parabolic mirror. Unlike the reflector in a traditional electric torch, there is no hole in the center of the reflector 11. The parabola formulae of the reflector's arc is $y^2=4Ax$, in which A is the distance between the maximum light emitting center of the light emitting diode 12 and the converging point of the reflector's arc. The open end of the reflector 11 forms a plane.

The thickness of the open end of the reflector 11 can be increased and an edge 15 can be added. The front cover 13 having no holes can be placed upon the edge 15 of the open end of the reflector 11. The front cover 13 can be fixed to the reflector 11 in many different ways such as by use of adhesive, which are known to those skilled in the art.

Figure 3:
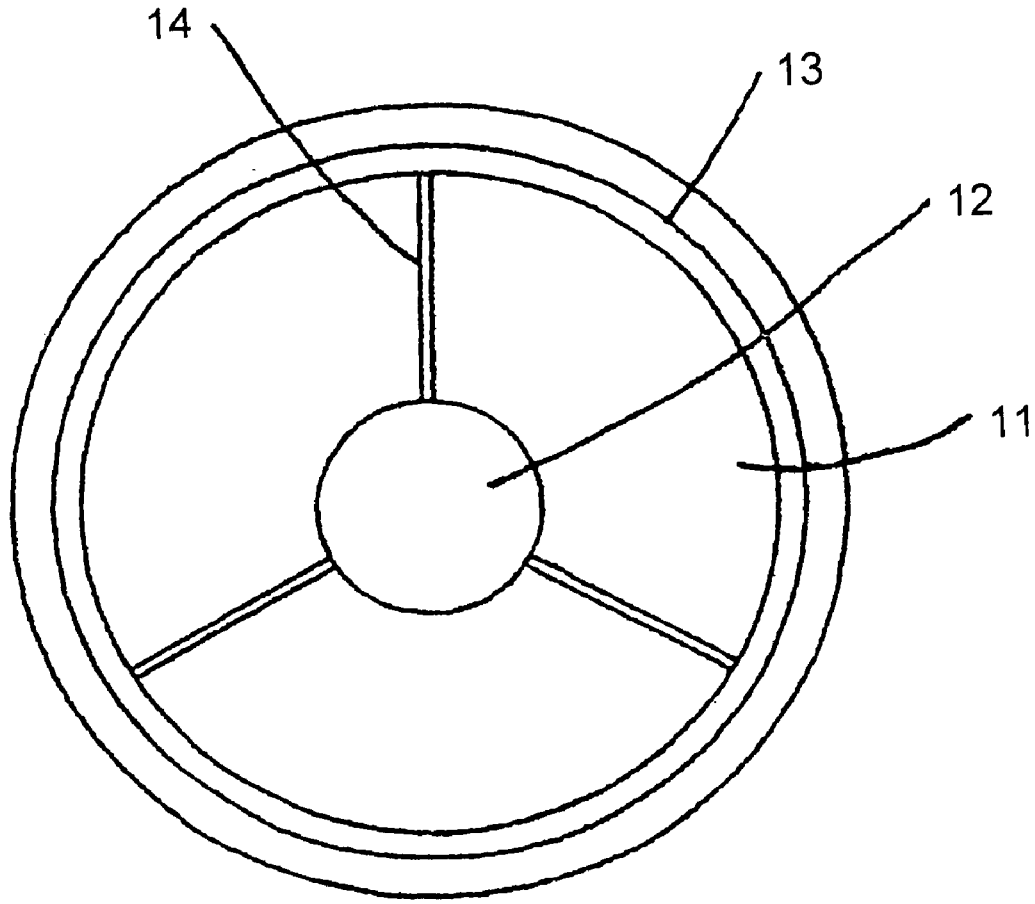
FIG. 3 shows the top plan view of FIG. 2.

As illustrated in FIGS. 2 and 3, the light emitting diode 12 is mounted at the center of the front cover 13 facing the converging point of the reflector 11. The stand of the light emitting diode 12 is fixed securely to the front cover 13, for example, by use of adhesive.

The two wires 14 of the light emitting diode 12 are led from the center of the front cover 13 to its edge and then to the back of the reflector 11 and finally to the body of the lighting equipment, thus the circuit between the batteries and the light emitting diode is completed. For aesthetic purposes, the wires 14 can be arranged on the front cover 13 as in FIG. 3. Three lines are distributed equally on the front cover 13 forming a balance.

The front cover 13 is made up of a transparent material such as glass.

The light emitting diode reflector can be used in electric torches as well as other portable lighting equipment such as lanterns.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A light emitting diode reflector comprising:

a reflector which is a one piece parabolic mirror having no holes and the parabola formulae of the reflector's arc is $y^2=4Ax$, in which A is the distance between the maximum light emitting center of the light emitting diode and the converging point of the reflector's arc;

a front cover which is placed upon the open end of the reflector and is made of a transparent material having no holes; and a light emitting diode which is mounted at the center of the front cover facing the converging point of the reflector.

* * * * *